US005373959A

United States Patent [19]

Haasewinkel

[11] Patent Number: 5,373,959

[45] Date of Patent: Dec. 20, 1994

[54] CONTAINER WITH A COVER

[75] Inventor: Gerhardus M. Haasewinkel, Oldenzaal, Netherlands

[73] Assignee: HK-Plastics B.V., Oldenzaal, Netherlands

[21] Appl. No.: 184,343

[22] Filed: Jan. 19, 1994

Related U.S. Application Data

[63] Continuation of Ser. No. 27,600, Mar. 5, 1993, abandoned, which is a continuation of Ser. No. 741,405, Jul. 23, 1991, abandoned.

[30] Foreign Application Priority Data

Oct. 25, 1989 [NL] Netherlands ..... 889.02650

[51] Int. Cl.[5] ..... B65D 43/06

[52] U.S. Cl. ..... 220/355; 220/214; 220/324; 220/763; 220/765; 220/769; 220/770; 220/771; 220/773; 292/266; 292/303; 292/305

[58] Field of Search ..... 220/324, 771, 751, 760, 769, 770, 772, 773, 762, 763, 764, 214, 765, 335, 356; 292/303, 305, 266

[56] References Cited

U.S. PATENT DOCUMENTS

| | | | |
|---|---|---|---|
| 802,220 | 10/1905 | Knapp | 220/324 |
| 2,114,910 | 4/1938 | Shattuck | 292/305 |
| 3,133,662 | 5/1964 | Seidler | 220/355 X |
| 3,730,382 | 5/1973 | Heisler | 220/94 A X |
| 3,811,597 | 5/1974 | Frankenberg et al. | 220/94 A X |
| 4,028,777 | 6/1977 | Schobel et al. | 24/16 PB |
| 4,293,073 | 10/1981 | Yates, Jr. | 206/519 |
| 4,351,448 | 9/1982 | Ingersoll et al. | 220/318 |
| 4,371,092 | 2/1983 | Teague | 220/324 |
| 4,380,304 | 4/1983 | Anderson | 220/94 A X |
| 4,405,166 | 9/1983 | Lovis | 292/305 |
| 4,412,630 | 11/1983 | Daenen | 220/355 X |
| 4,609,125 | 9/1986 | Willingham | 220/324 |
| 4,746,008 | 5/1988 | Heverly et al. | 206/1.5 |
| 4,833,737 | 5/1989 | Boucher et al. | 292/266 X |
| 4,985,867 | 9/1990 | Champagne | 292/303 X |
| 4,998,622 | 3/1991 | Drack | 220/770 X |
| 5,046,636 | 9/1991 | Coskery | 220/94 A X |
| 5,102,001 | 4/1992 | Teague et al. | 220/324 |
| 5,111,954 | 5/1992 | Gaudreault | 220/94 A X |

FOREIGN PATENT DOCUMENTS

| | | | |
|---|---|---|---|
| 1265181 | 3/1960 | France | 220/324 |
| 2300245 | 9/1976 | France . | |
| 626259 | 1/1936 | Germany | 220/324 |
| 252108 | 9/1948 | Switzerland | 220/324 |
| 1111665 | 5/1968 | United Kingdom . | |

*Primary Examiner*—Allan N. Shoap
*Assistant Examiner*—Nova Stucker

[57] ABSTRACT

A container is disclosed for packaging food, paint or the like. The container includes a cover having a lip which engages a top edge of the container and is sealed on the container by one or more sealing elements. The sealing elements include a hook which engages a skirt located on the container and a jaw which engages the cover lip. The hook and jaw are lockable together. The skirt further includes handles and a recess so that the cover can be easily removed from the container.

14 Claims, 2 Drawing Sheets

CONTAINER WITH A COVER

This is a continuation of application Ser. No. 08/027,600, filed on Mar. 5, 1993, now abandoned, which is a continuation of application Ser. No. 07/741,405, filed Jul. 23, 1991, now abandoned.

BACKGROUND OF THE INVENTION

The present invention relates to containers with covers such as those manufactured in great numbers for the purpose of packaging food, paint and the like. The container and cover are usually injection molded from plastic, such as polyethylene, polypropylene and the like, the cover being typically manufactured from a softer plastic than the container.

Such containers have to be properly closable and relatively easy to open.

It is also important that such container have an attractive appearance as this enhances the marketability of the contents.

SUMMARY OF THE INVENTION

The present invention relates to a container provided with hand-grips which lie comfortably in the hand and do not disturb the compact appearance of the container. The container is nestable and stackable with its cover on. The hand-grips are formed on a skirt surrounding the open end of the container.

Another aspect of the present invention relates to the printing of text on such containers. The handle is disposed so that it does not block the outer surface of the container during printing thereof. Ordinarily, handles are attached to containers after the containers are printed, which usually takes place manually and also necessitates extra storage and transport.

If the handle is embodied in plastic and rests on stop elements or it is virtually invisible, thus not disturbing the compact appearance of the container.

A further aspect of the present invention relates to sealing of covers on such containers so as to prevent poison, contraband and the like, from being added to the contents of the container by unauthorized persons.

The present invention further provides a novel sealing element for accomplishing the sealing of the cover to the container.

BRIEF DESCRIPTION OF THE DRAWINGS

Further details, features and advantages will become apparent in the light of a description of preferred embodiments and embodiments of the present invention with reference to the annexed drawings, wherein.

DETAILED DESCRIPTION OF THE INVENTION

In the present invention a distinction can be made between containers having a capacity in the range of about 0.4–14 liters and larger holders, because customers for these two types of containers are wholly distinct. In addition, the smaller capacity holders are generally supplied without handles.

Figure 1:
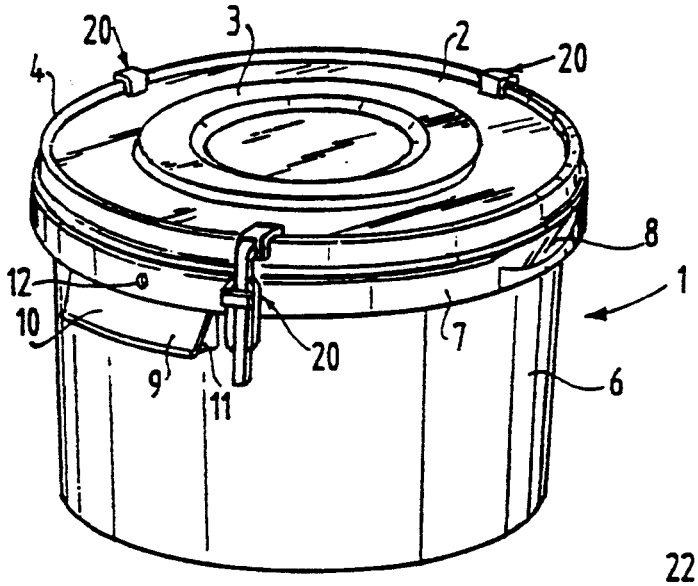
FIG. 1 shows a perspective view of a first preferred embodiment of the present invention.

The container 1 (FIG. 1) of for instance, 5 liter capacity is provided with a cover 2 in which an upstanding disc 3 is arranged for the purpose of stacking with a corresponding base (not shown) of another container.

Figure 2:
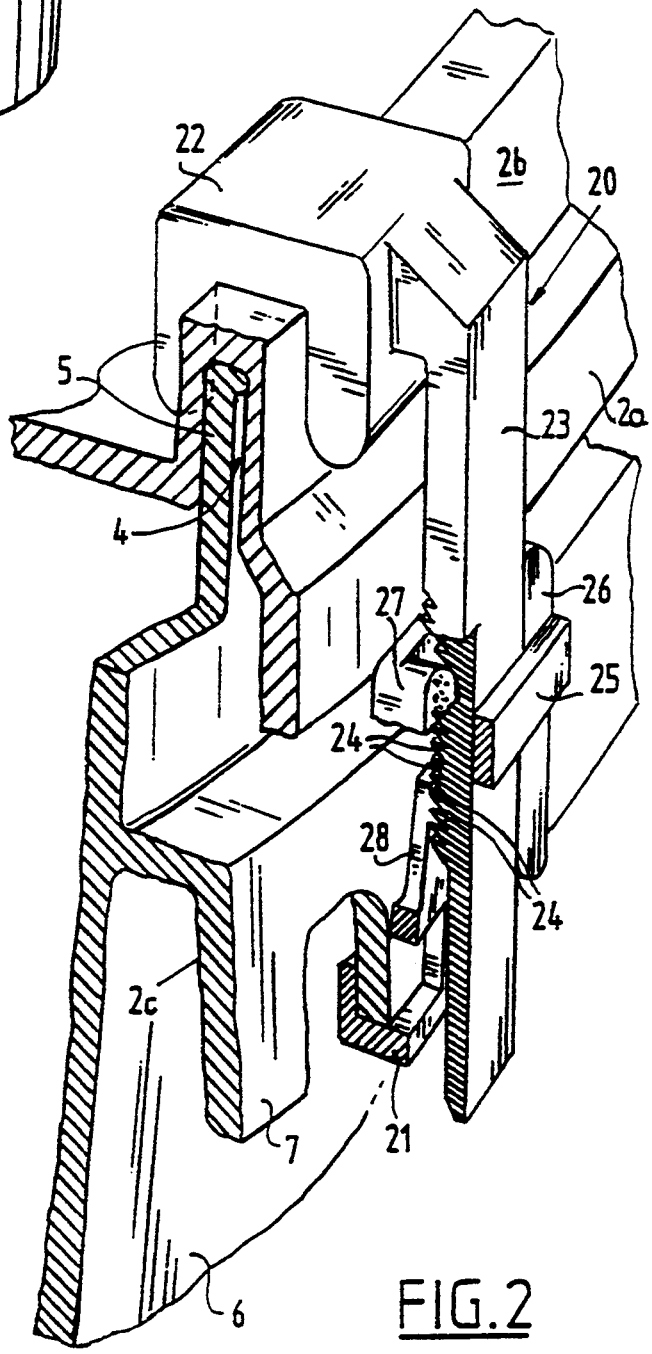
FIG. 2 shows a partly cut away perspective view of the preferred embodiment of FIG. 1.

As can also be seen in FIG. 2, the cover 2 is provided with a lip 2*a*, including outer surface 2*b* and inner surface 2*c*, and a groove 4 which grips over a top edge 5 of the container 1. In addition, a downward hanging skirt 7 is arranged on the side wall 6 of container 1. Around the skirt 7 is arranged a recess 8 for easy bending of the cover during opening of the container.

Arranged on the skirt 7 are one or more hand-grips 9. The outer surface 10 of the hand-grips 9 stands out slightly more than the skirt 8, so that a user can place his hand thereunder while the angle is not so large that the compact appearance of the outer wall of the container is disturbed. In addition, the hand-grip supports the skirt 7 by means of the side walls 11. The hand-grip 9 further forms a stop for the nesting of such containers, while a number of nested containers or buckets can be carried on the hand-grip. Preferably, an eye 12 is arranged above the middle of the hand-grip 9, wherein a second handle can be simply placed.

The cover 2 is preferably sealed onto the container 1 using a plurality of sealing elements 20 (FIGS. 1, 2 and 3), the number whereof a number, depending on the size of the container. In the embodiment shown three sealing elements are arranged at regular intervals around the cover.

Figure 3:
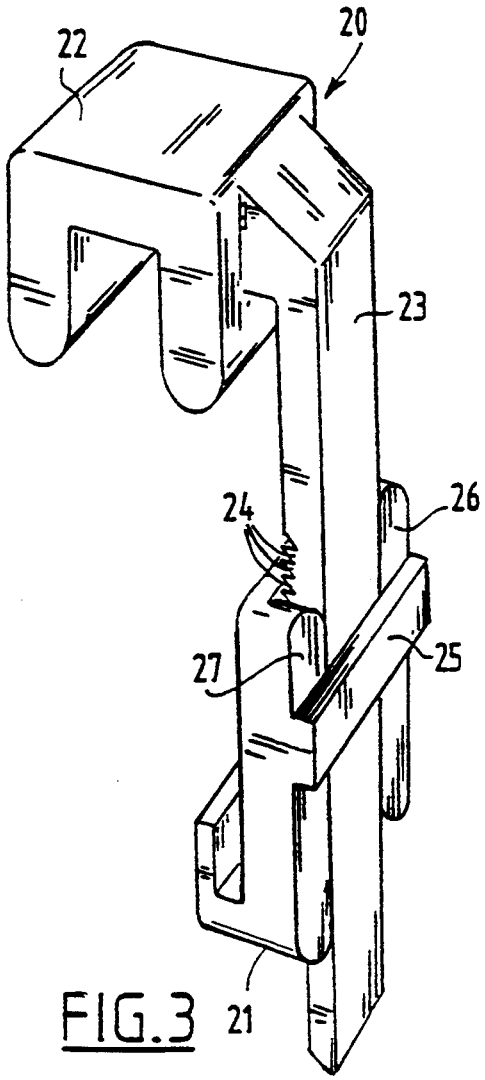
FIG. 3 shows a perspective view of a sealing element according to the present invention.

As can be seen in FIGS. 2 and 3, the sealing elements 20 can be attached to the container and the cover in a simple operation. As shown in FIG. 3, the sealing elements 20 consist of two pieces: an upper jaw member 22 with a downwardly extending arm 23; and a hook 21 with two upwardly extending arms 26, 27.

After a hook 21 has been hooked under the skirt 7 of the container jaw member 22 is pushed over the top side of the groove 4 of the cover. Arm 23 is provided with upward oriented teeth 24. As can be seen in FIG. 2, the arm 23 is received between a bridge element 25 which extends transversely of the arm 23 and which is fixed between two upwardly directed arms 26 and 27 and a lip 28 which grips onto the teeth 24.

As will be apparent, such a sealing element can only be removed through forcing, that is breaking, thereof.

Depending on the stiffness of the arm 23 and the lip 28, the sealing number can be provided with a second bridge element parallel to the bridge element 25 but arranged at some interval above or below it to further secure arm 23 in place.

Figure 4:
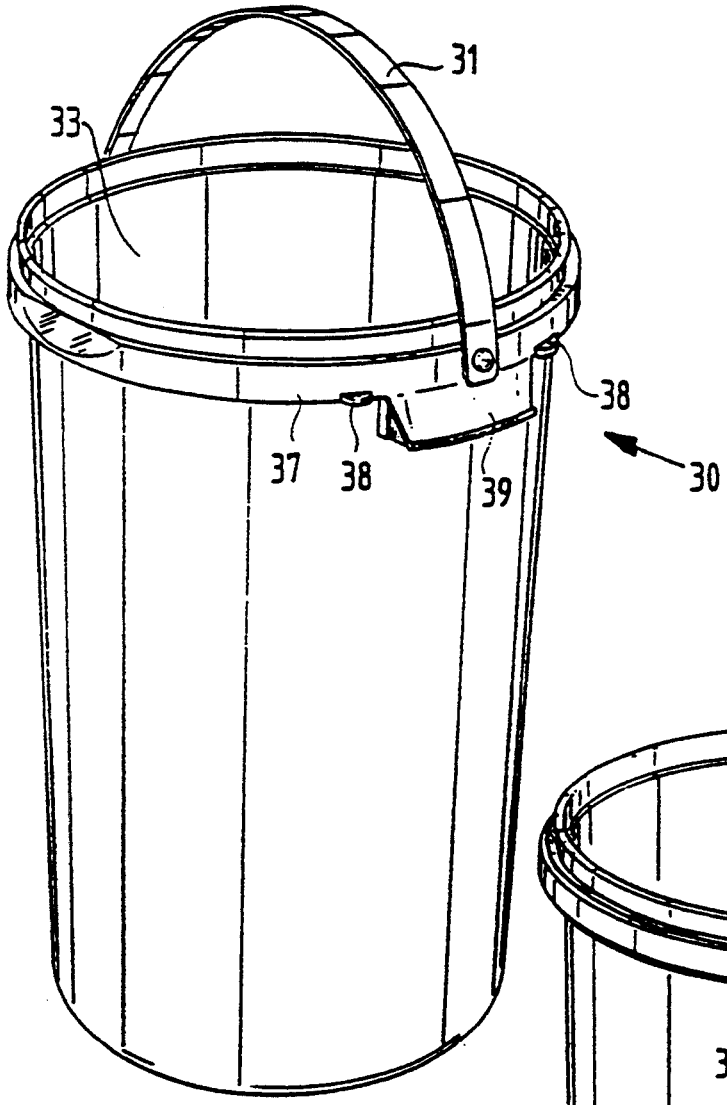
FIG. 4 is a perspective view of another preferred embodiment of the present invention.
Figure 5:
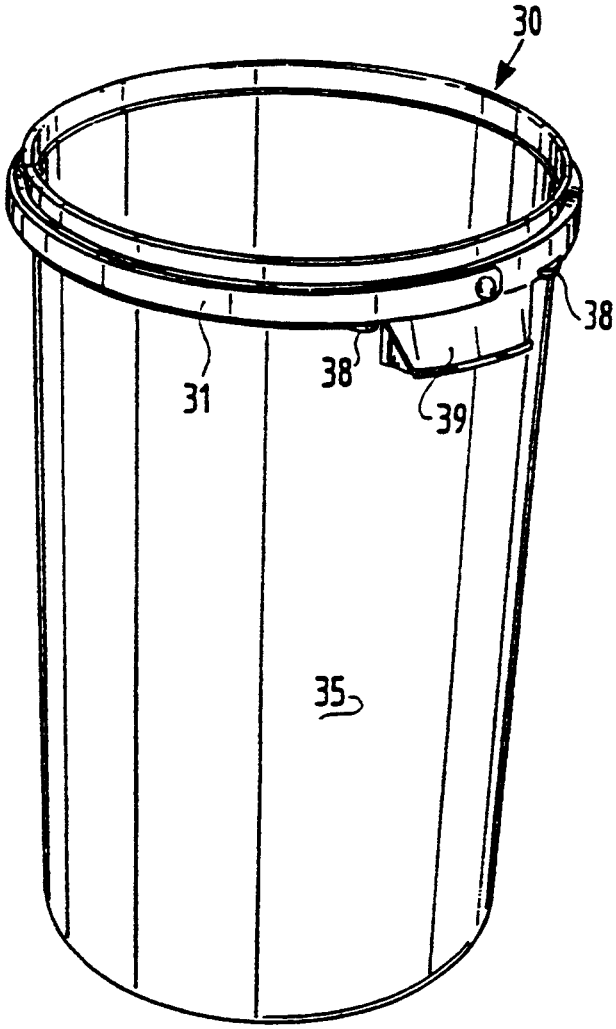
FIG. 5 is a perspective view of the holder of FIG. 4 with a freely accessible top opening.

The embodiment shown in FIGS. 4 and 5 relates to a container with a capacity of more than 15 liters on which a plastic handle 31 is arranged using the eyes above the hand-grips 39, while the skirt 37 is provided with one or more protruding stop elements 38. As the handle 31 has an only slightly greater length than half the outer periphery of the opening 33 of the container it will rest in a downward pivoted position (FIG. 5) on one or more stop elements such that the handle does not form an obstacle to the printing of text on the outer wall 35 of container 30.

Furthermore, the handle 31, in its downward pivoted position does not disturb the appearance of container 30, for instance when the hand-grips are used to carry this container 30.

I claim:

1. A container, comprising:

(a) a container body having an open end, a bottom end and a side wall between said open end and said bottom end, said open end being provided with a top edge, said sidewall having a skirt thereon near said top edge, said skirt having a recess formed therein;

(b) a cover for covering the open end of said container, said cover having a lip with an inner surface and an outer surface, the inner surface of said lip forming a groove adapted to engage the top edge of said container body, the cover being removable from the container by gripping the inner surface of said lip at said recess in said skirt;

(c) at least one sealing member for sealing said cover to said container body, said sealing member having a hook adapted to hook under said skirt of said container body and a jaw member adapted to hook over the outer surface of said lip of said cover.

2. A container in accordance with claim 1, further comprising at least one handgrip extending from said skirt.

3. A container in accordance with claim 1, further comprising an eye located on said skirt for receiving a handle, said handle being pivotable between an upright position and a stored position where the handle rests on said skirt.

4. A container in accordance with claim 3, further comprising stop elements located on said skirt for supporting said handle in the stored position.

5. A container in accordance with claim 4, wherein said handle is made of plastic and has a length which is slightly greater than half of the circumference of said open end of said container.

6. A container in accordance with claim 1, wherein said hook and said jaw member are movable with respect to one another, and said sealing member includes locking means for locking the relative position between said jaw member and said hook to seal said cover onto said container.

7. A container in accordance with claim 6, wherein said locking means comprises:

an arm integral with said jaw member, said arm having a plurality of teeth; and a lip integral with said hook, said lip being engagable with said teeth of said arm.

8. A container in accordance with claim 7, further comprising at least one bridge element for retaining said arm in sliding engagement with said hook.

9. A container in accordance with claim 1, wherein said skirt extends towards said bottom end of said container at an angle relative to said side wall.

10. A container in accordance with claim 9, further comprising at least one handgrip extending from said skirt towards said bottom end of said container at an angle substantially the same as said skirt.

11. A container with a cover, wherein the container is provided with an open end, a top edge extending substantially along an outer periphery of said open end, a downwardly facing circumferential skirt extending outwardly from said container near said top edge, and a handle pivotally attached to said skirt;

wherein the cover is provided with a groove adapted to engage said top edge of said container;

wherein the handle consists of a plastic material and has a length that is greater than half the circumference of the skirt of said container;

wherein stop means are provided on the skirt for limiting downward pivotal movement of the handle; and wherein handgrips are formed on the skirt, above which handgrip eyes are arranged, the handle being attached to the handgrip eyes.

12. A container with a cover, wherein the container is provided with an open end, a top edge extending substantially along an outer periphery of said open end, a downwardly facing circumferential skirt extending outwardly from said container near said top edge, and a handle pivotally attached to said skirt;

wherein the cover is provided with a groove adapted to engage said top edge of said container;

wherein the handle consists of a plastic material and has a length that is greater than half the circumference of the skirt of said container; and wherein stop means are provided on the skirt for limiting downward pivotal movement of the handle, said stop means comprising stop bosses for the handle to rest on, when the handle is pivoted into a downward position.

13. A container according to claim 11, further comprising at least one sealing element for sealing said cover to said container.

14. A container according to claim 12, further comprising at least one sealing element for sealing said cover to said container.

* * * * *